United States Patent [19]

Migliore

[11] Patent Number: 4,640,076

[45] Date of Patent: Feb. 3, 1987

[54] ASSEMBLY SYSTEM WITH CLIP FOR INSTALLING MARBLE PANELS

[76] Inventor: Neil Migliore, 234 New York Ave., Huntington, N.Y. 11743

[21] Appl. No.: 763,524

[22] Filed: Aug. 8, 1985

[51] Int. Cl.[4] ..... E04B 2/92; E04B 1/38

[52] U.S. Cl. ..... 52/509; 52/512

[58] Field of Search ..... 52/509, 235, 489, 779, 52/136, 137, 139, 140, 714, 715, 127.7, 546, 547, 512, 513, 378, 379

[56] References Cited

U.S. PATENT DOCUMENTS

| | | | |
|---|---|---|---|
| 1,052,670 | 2/1913 | LaFrancis | 52/509 |
| 1,241,885 | 10/1917 | Roeder | 52/714 |
| 1,988,147 | 1/1935 | Voight | 52/779 |
| 2,009,960 | 7/1935 | Johnson | 52/779 |
| 2,066,205 | 12/1936 | Keating | 52/508 |
| 3,031,044 | 4/1962 | Stitt | 52/512 |
| 3,319,983 | 5/1967 | Zibell | 52/489 |
| 3,478,480 | 11/1969 | Swenson | 52/714 |
| 3,561,182 | 2/1971 | Madl | 52/779 |
| 3,786,605 | 1/1974 | Winfrey | 52/235 |
| 4,040,223 | 8/1977 | Hillstron | 52/235 |
| 4,052,831 | 10/1977 | Roberts | 52/509 |
| 4,223,505 | 9/1980 | Krebel | 52/509 |
| 4,255,914 | 3/1981 | Seipos | 52/509 |
| 4,455,794 | 6/1984 | MacKinnon | 52/464 |

FOREIGN PATENT DOCUMENTS

| | | | |
|---|---|---|---|
| 2635611 | 2/1978 | Fed. Rep. of Germany | 52/513 |
| 563445 | 8/1944 | United Kingdom | 52/509 |

*Primary Examiner*—John E. Murtagh

*Attorney, Agent, or Firm*—Peter L. Berger

[57] ABSTRACT

A system for installing individual marble panels on flat wall surfaces is disclosed which eliminates the need for skilled artisans to do the installation. The marble individual panels are formed of a thin marble layer which is attached to a backing layer. Special clips are attached to the flat wall surface to which the marble panels are to be secured. The clips are inserted in routed out portions in the backing layer behind the layer of marble. A system for ensuring effective, efficient and foolproof installation of the marble panels is provided.

11 Claims, 5 Drawing Figures

ASSEMBLY SYSTEM WITH CLIP FOR INSTALLING MARBLE PANELS

BACKGROUND OF THE DISCLOSURE

This invention relates to an assembly for installing marble panels without requiring skilled artisans.

Marble panels and walls have always been a desirable architectural and interior design feature. Conventionally, such marble panels are provided by a solid marble slab which must be secured to a flat surface. A skilled artisan is required to handle the slab and to secure it to the flat surface without cracking or breaking the marble. Obviously, this is a time consuming and expensive process, and the damage to marble slabs which occurs is a very expensive problem.

One attempt to eliminate the need of such an assembly procedure has been to provide materials made of plastic which are marble look-alikes and which are assembled as squares on a wall surface. Obviously, such squares do not resemble a marble panel, and the undesirability of such squares as a replacement for natural marble is quite clear.

An object of this invention is to provide a marble panel and assembly system which enables whole marble panels of the size of a natural marble slab to be installed without requiring skilled artisans.

Another object of this invention is to provide such an assembly system which is relatively foolproof, simple to use and easy adaptable to on-site installation.

Still another object of this invention is to improve the time and efficiency of installation of marble walls which materially can reduce the installation cost.

Yet another object of this invention is to provide such a system in which cracking and breaking of marble slabs is eliminated, yet in which marble walls are installed with the apparent thickness of marble slabs.

Other objects, advantages and features of this invention will become more apparent from the following description.

SUMMARY OF THE INVENTION

In accordance with the principles of this invention, the above objects are accomplished by providing an assembly system for assembling marble panels to a and formed of a sheet of marble attaching to a backing layer, a backing layer being made of a honeycomb construction. A clip of an H-shaped is provided which is attached to the wall or to an attaching strip which itself is attached to the wall. The backing layer of the marble panel is routed so that the clip can be inserted in the routed portion. The clip is fastened to the wall or to the fastening strip, and once so fastened, a marble panel is inserted in the clip in the routed out section of the backing layer. The next marble panel is then inserted in the other side of the H-shaped clip also in a routed-out area of the backing layer of the marble panel. In this way, two adjoining marble layers are connected and held together by the same clip and abut each other in the area of the web which is part of the H-shaped clip. The details of this invention will be more fully understood by referring to the following description.

DETAILED DESCRIPTION

Figure 1:
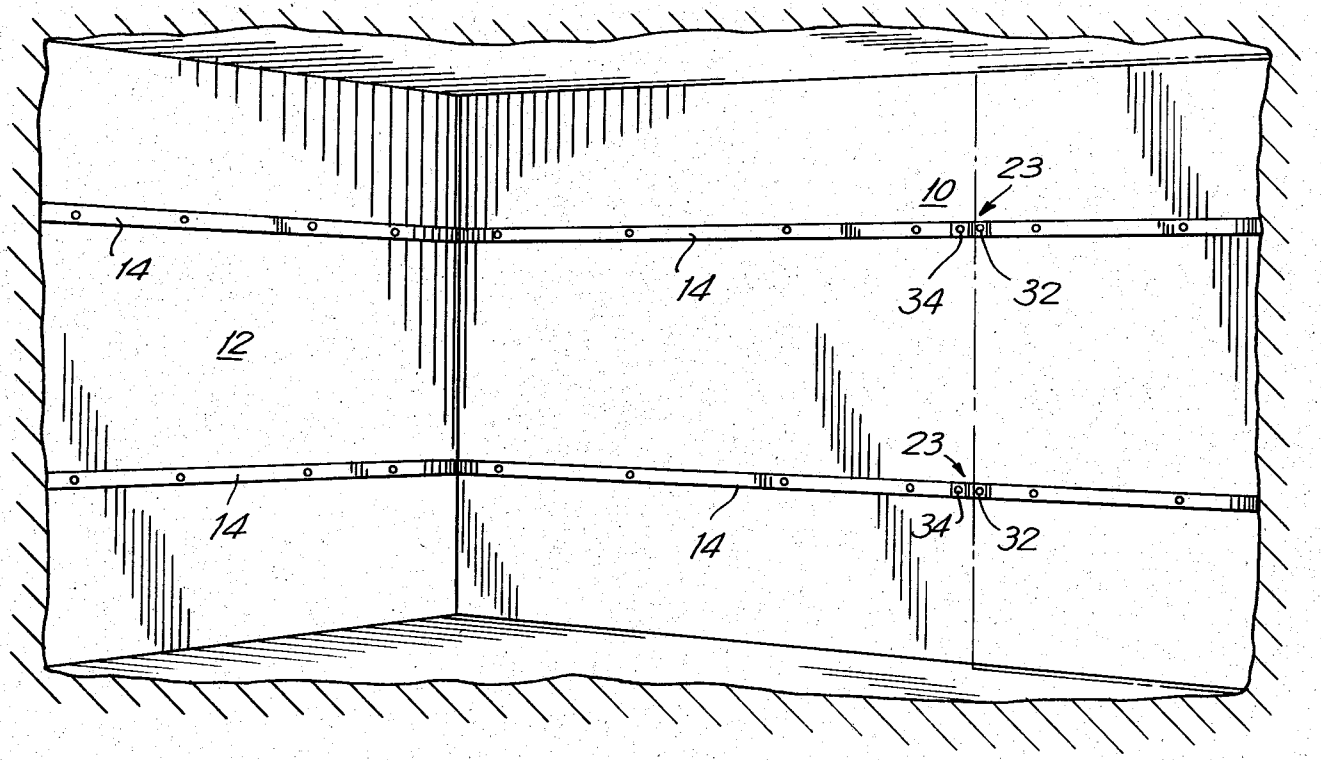
FIG. 1 is a perspective view of a front and side wall having mounting strips attached thereto.

FIG. 1 illustrates a flat surface or wall 10 and a perpendicular flat surface or wall 12. These walls are illustrative of structures to which marble panels can be attached to assemble marble walls. These walls which are generally finished with sheet rock attached to sticks in the conventional manner. In order to effectively attach the individual marble panels of this invention to the wall, fastening strips 14 are attached to the wall at preselected heights. The fastening strips 14 are level on the wall to enhance the assembly and installation of the marble panels.

Figure 3:
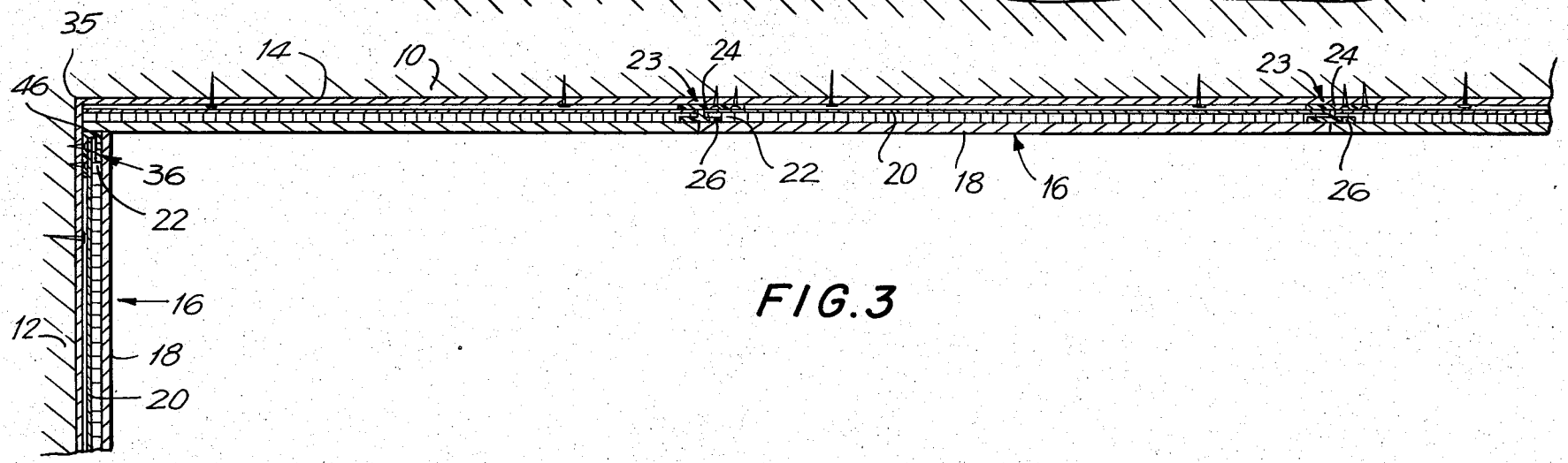
FIG. 3 is a sectional view taken along the lines 3—3 showing the assembly of the panels to the wall.

FIG. 3 illustrates a sectional view of the panels attached to the wall. Each panel 16 generally comprises a thin marble layer 18 and a co-extensive backing layer 20. The backing layer is formed of a honeycomb or similar material which may be routed out as at 22, so that the clips of the invention can be inserted by the backing layer to hold the marble panel. Each marble panel is assembled prior to being set up at the job site, but the routing out of the backing layers preferably takes place at the job site in order to enhance the accuracy of the installation.

Figure 4:
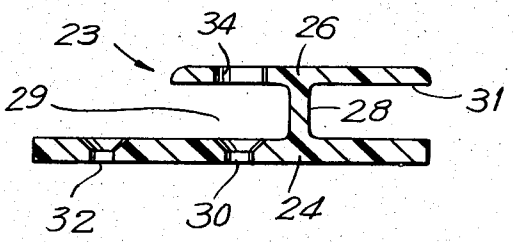
FIG. 4 is a top view of a clip of an H-shaped clip forming part of this invention.
Figure 2:
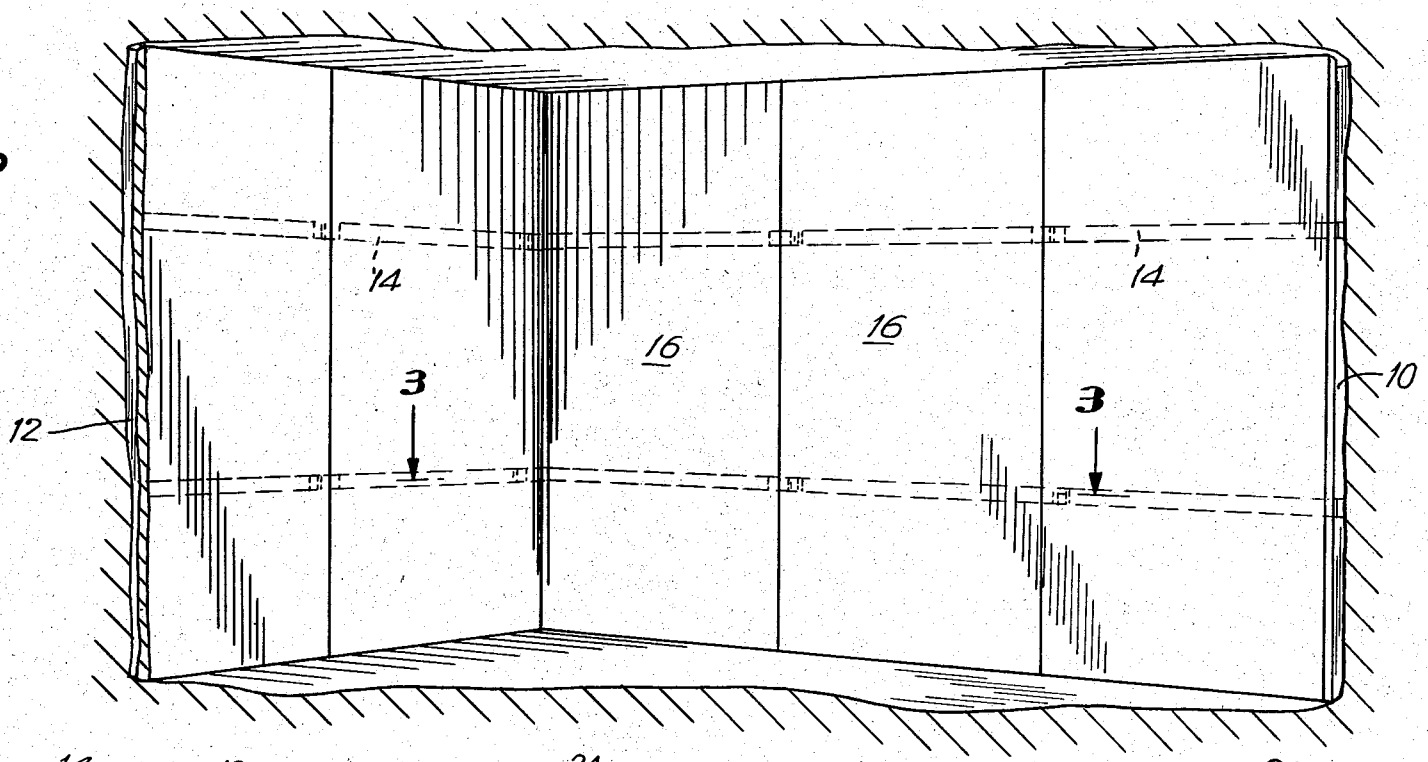
FIG. 2 is a perspective view of the front and side wall of FIG. 1 with the marble panels attached thereto.

The system of this invention utilizes an H-shaped clip 23 (see FIG. 4). It is comprised of an inner common leg 24 and an outer common leg 26 between which there is located a web 28 to form back-to-back left and right channels 29 and 31, respectively. The inner and outer legs are parallel to each other, and the unitary clip may be made of plastic. A pair of apertures 30 and 32 are provided through the inner leg, on one side of the web, while an aperture 34 is provided on the same side of the outer leg to align with aperture 30 of the inner leg. The fastening strips 14 are attached to the wall by suitable screws, bolts or the like to be level and at preselected heights. The clips can be fastened to the fastening strips or directly to the wall. The fastening strips 14 may be made of aluminum or plastic, as desired.

A first clip 23 is attached to the wall as shown in phantom in FIG. 1. Upper and lower clips 23 may be provided. Once the clips 23 are attached to the fastening strips 14, a first marble panel 16 is inserted in the right hand channel 31. The next marble panel is installed after its backing layer 20 is routed out as at 22. The next marble panel is then slid into the left channel 29 of clip 23 and is securely held therein. The inner common leg 24 of the clip bears against the fastening strip 14, while the outer leg 26 sits in the routed area 22 in the backing layer. Similarly, outer leg 26 of the left channel 29 of clip 23 will sit in the routed out portion of the backing layer so that the marble panels may be installed by merely inserting them into the clips which are attached on the wall. As may be understood, adjoining marble panels will abut each other in the area of the web 26.

Figure 5:
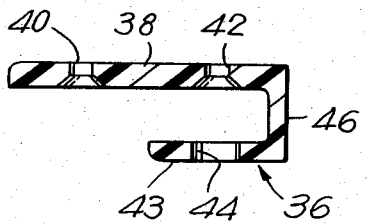
FIG. 5 is a top plan view of a corner U-shaped clip forming part of this invention.

The marble panels are then installed from right to left, until the left corner 35 of front wall 10 is reached. At this point, the last panel is cut at the site to be flush with left wall 12. FIG. 3 illustrates the use of the corner clips 36 (FIG. 5). Corner clip 36 has a generally U-shape with an inner leg 38 with apertures 40 and 42, an outer leg 43 with an aperture 44 connected by a base 46. The clip 36 is mounted against fastening strip 14 or directly on the wall surface 12, as appropriate. The corner clip will be inserted with its base 46 bearing against the left front edge of the marble panel adjacent side wall 12. The corner clips are securely fashioned to the wall through apertures 40, 42 and 44 in the conventional fashion and a first marble panel 16 is assembled on left wall 12 by inserting the marble clip in the routed out portion of the backing layer of the marble panel. In this way, the corner clip holds the front marble panel firmly against front wall 10 while beginning the corner turn for the marble panel attached to side wall 12.

The thickness of U-shaped corner clip 36 or H-shaped clip 23 in conjunction with the routed out portion 20 is such that the front outer leg 26 will not bend when inserted in the routed out portion. This prevents a cocking or unevenness to occur between adjacent marble panels.

As may be readily understood, marble walls may be assembled which appear to be full marble slabs, without requiring such full marble slabs. This not only reduces the cost of such marble walls, but also the cost of installation and eliminates the need for skilled artisans to assemble such marble slabs. The present invention provides for a relatively foolproof method of assembling marble wall panels which will have the same appearance as marble slabs.

The above invention has been described with regard to a preferred embodiment. Other modifications and changes may be made by those of ordinary skill in the art without departing from the teachings of this invention.

What is claimed is:

1. A system for assembling and attaching marble panels substantially flush to a flat surface to give the appearance of marble slabs or surfaces, said system comprising:

a plurality of marble panels, each marble panel including a marble sheet and a coextensive backing layer attached thereto which is routed out adjacent said marble sheet at selected portions thereof to define thin sections spaced from said marble sheet at said selected portions, independent and separate fastening strips attached to said flat surface, said fastening strips attached on said surface at preselected heights, a plurality of clips adapted to be secured to said fastening strips for laterally aligning said marble panels on said flat surface;

each clip including an inner leg, an outer leg spaced-apart and parallel to said inner leg, and a transverse web interconnecting said inner and outer legs in a spaced-apart and parallel arrangement to define a guide channel, said guide channel receiving said panels in a non-load bearing manner to laterally align said marble panels;

said inner leg of each clip being secured to said fastening strips at an orientation substantially parallel to the horizontal such that each said guide channel laterally guides the marble panels with respect to each other such that vertical edges of adjacent panels are in abutment and substantially co-planar;

wherein the spacing between respective portions of said common inner and outer legs of each clip which define (of) said guide channel said legs to be freely inserted in the backing layer of said panels to eliminate bending of the outer common leg of the clip.

2. A system as claimed in claim 1, wherein said backing layer comprises a honeycomb assembly.

3. A system as claimed in claim 1, wherein at least one said clip comprises an H-shape unitary assembly formed of a common inner leg, a spaced-apart common outer leg and a common web connected therebetween to form back-to-back guide channels, a portion of the inner leg defining one of said guide channels including said at least one aperture enabling said clip to be attached to said surface, said one guide channel receiving a routed out portion of said backing layer of a first marble panel to laterally align and hold said marble panel, a second marble panel having its backing layer routed out and inserted in the other guide channel of said clip, with the marble sheets of said first and second marble panels extending over said common outer leg and abutting each other in the vicinity of said common web.

4. A system as claimed in claim 1, wherein at least one said clip comprises an H-shape unitary assembly formed of a common inner leg, a spaced-apart common outer leg and a common web connected therebetween to form back-to-back guide channels, a portion of the inner leg defining one of said guide channels including said at least one aperture enabling said clip to be attached to said surface, said one guide channel receiving a routed out portion of said backing layer of a first marble panel to laterally align and hold said marble panel, a second marble panel having its backing layer routed out and inserted in the other guide channel of said clip, with the marble sheets of said first and second marble panels extending over said common outer leg and abutting each other in the vicinity of said common web.

5. A system as claimed in claim 3, wherein the outer leg includes at least one aperture aligned with at least one aperture in said inner leg.

6. A system as claimed in claim 4, wherein the outer leg includes at least one aperture aligned with at least one aperture in said inner leg.

7. A system as claimed in claim 3, wherein said clip is made of plastic.

8. A system as claimed in claim 4, wherein said clip is made of plastic.

9. A system as claimed in claim 1, wherein at least one said clip is a corner clip and comprises an unitary assembly having a U-shape to hold one marble panel to a first flat surface, a base of said corner clip bearing against said one marble panel, the corner clip enabling installation of a second marble panel on a surface substantially perpendicular to said first flat surface.

10. A system as claimed in claim 9, wherein said corner clip is made of plastic.

11. A system as claimed in claim 1, wherein said clip is made of plastic.

* * * * *